United States Patent [19]

Klompas

[11] Patent Number: 4,492,517

[45] Date of Patent: Jan. 8, 1985

[54] SEGMENTED INLET NOZZLE FOR GAS TURBINE, AND METHODS OF INSTALLATION

[75] Inventor: Nicholas Klompas, Scotia, N.Y.

[73] Assignee: General Electric Co., Schenectady, N.Y.

[21] Appl. No.: 456,288

[22] Filed: Jan. 6, 1983

[51] Int. Cl.[3] ..... F01D 11/00

[52] U.S. Cl. ..... 415/139; 415/115; 415/189; 416/217

[58] Field of Search ..... 415/139, 115, 189, 170 R, 415/219 B; 416/196, 192, 190

[56] References Cited

U.S. PATENT DOCUMENTS

| | | | |
|---|---|---|---|
| 2,430,140 | 11/1947 | Phelan et al. | 416/217 |
| 2,654,566 | 10/1953 | Boyd et al. | 415/137 |
| 2,741,455 | 4/1956 | Hunter | 415/137 |
| 2,801,075 | 7/1957 | Broffitt | 415/137 |
| 2,968,467 | 1/1961 | McGregor | 415/136 |
| 3,062,499 | 11/1962 | Peterson | 415/137 |
| 3,066,911 | 12/1962 | Anderson et al. | 415/138 |
| 3,075,744 | 1/1963 | Peterson | 415/137 |
| 3,142,475 | 7/1964 | Bobo et al. | 415/139 |
| 3,262,677 | 7/1966 | Bobo et al. | 415/139 |
| 3,302,925 | 2/1967 | Musick | 416/196 |
| 3,377,050 | 4/1968 | Guy | 416/192 |
| 3,501,247 | 3/1970 | Tournere | 415/189 |
| 3,511,577 | 5/1970 | Karstensen | 415/138 |
| 3,542,483 | 12/1970 | Gagliardi | 415/139 |
| 3,552,753 | 1/1971 | Mierley | 415/115 |
| 3,752,598 | 8/1973 | Bowers et al. | 415/139 |
| 3,892,497 | 7/1975 | Gunderlock et al. | 415/139 |
| 3,938,906 | 2/1976 | Michel et al. | 415/139 |
| 3,970,318 | 7/1976 | Tuley | 415/139 |
| 3,981,615 | 9/1976 | Krol | 416/190 |
| 3,986,789 | 10/1976 | Pask | 415/139 |
| 4,137,619 | 2/1979 | Beltran et al. | 29/156.8 H |
| 4,194,869 | 3/1980 | Corcokios | 415/191 |
| 4,274,805 | 6/1981 | Holmes | 415/139 |
| 4,283,822 | 8/1981 | Muth et al. | 29/156.8 H |
| 4,295,785 | 10/1981 | Lardellier | 415/139 |
| 4,355,952 | 10/1982 | Brown et al. | 415/115 |
| 4,384,822 | 5/1983 | Schweikl et al. | 415/115 |

FOREIGN PATENT DOCUMENTS

| | | | |
|---|---|---|---|
| 1202356 | 7/1959 | France | 415/136 |
| 1340331 | 9/1963 | France | 415/191 |
| 106006 | 8/1924 | Switzerland | 415/136 |
| 865545 | 4/1961 | United Kingdom | 415/115 |

*Primary Examiner*—Edward G. Favors
*Assistant Examiner*—John Kwon
*Attorney, Agent, or Firm*—J. C. Squillaro

[57] ABSTRACT

A gas turbine nozzle guide vane assembly is formed of individual arcuate nozzle segments. The arcuate nozzle segments are elastically joined to each other to form a complete ring, with edges abutted to prevent leakage. The resultant nozzle ring is included within the overall gas turbine stationary structure and secured by a mounting arrangement which permits relative radial movement at both the inner and outer mountings. A spline-type outer mounting provides circumferential retention. A complete rigid nozzle ring with freedom to "float" radially results. Specific structures are disclosed for the inner and outer mounting arrangements. A specific tie-rod structure is also disclosed for elastically joining the individual nozzle segments. Also disclosed is a method of assembling the nozzle ring subassembly-by-subassembly into a gas turbine employing temporary jacks.

16 Claims, 12 Drawing Figures

SEGMENTED INLET NOZZLE FOR GAS TURBINE, AND METHODS OF INSTALLATION

The invention disclosed herein was made in the course of, or under, a contract with the U.S. Department of Energy.

BACKGROUND OF THE INVENTION

The present invention relates to nozzle guide vane assemblies, particularly the inlet nozzle of a large gas turbine engine, and methods for assembly of such nozzle guide vane assemblies into a gas turbine engine.

A nozzle guide vane assembly is part of the stationary (non-rotating) structure in an axial flow gas turbine engine. In overall configuration, this assembly comprises concentric outer and inner ring-like nozzle bands defining an annular space therebetween, which annular space is a portion of the hot gas path through the gas turbine engine. A plurality of air foil-shaped vanes extend generally radially between the nozzle bands, nozzles being defined between the vanes.

Stationary nozzle guide vane assemblies are either inlet nozzles or interstage nozzles. An inlet nozzle is conventionally positioned on the turbine axis between the gas turbine combustor and the first stage turbine rotor, and serves to direct motive fluid in the form of high temperature combustion products against the rotor blades (also termed "buckets") at a proper angle. Interstage nozzle guide vane assemblies perform a similar function, but are located along the turbine axis between individual rotor assemblies. The present invention is primarily concerned with gas turbine inlet nozzle assemblies because the various thermal and mechanical stresses are most severe in that location. However, the principles of the invention are also applicable to interstage nozzle guide vane assemblies.

The nozzle bands are called by various terms in this art, such as nozzle shrouds. However, for clarity and consistency, herein these bands are termed inner and outer nozzle "endwall rings" since they are in effect located at the ends of the nozzle vanes which extend between the endwall rings.

Except for very small gas turbines, it is impractical to make the entire nozzle guide vane assembly a single rigid lattice with continuous inner and outer endwall rings and vanes fixed at both ends to both endwall rings. This is because stresses occasioned by thermal expansions and accompanied by gas loading result in dispersion and ultimate destruction of the nozzle structures.

One conventional approach to this problem is to form the nozzle guide vane assembly as a plurality of individual arcuate nozzle segments individually retained by a separate ring-like support shroud or casing. Seal structures are typically provided between adjacent segments where necessary. The arcuate nozzle segments may be either one-vane or multi-vane, and each nozzle segment generally comprises one or more vanes extending between a nozzle segment inner endwall and a nozzle segment outer endwall. In the completed structure, generally circumferentially-facing edges of each nozzle segment are located adjacent to corresponding circumferentially-facing endwall edges of adjacent nozzle segments to form continuous inner and outer endwall rings.

Various other approaches to this problem have also been proposed. For example, in one particular other approach, the nozzle vanes are formed separately from one or both of the endwall rings, and the endwall rings may themselves either be one-piece or formed from individual endwall ring segments. Specific design proposals embodying this general type of structure include various specific forms of attachment of the nozzle vanes to the endwall rings, typically permitting relative movement, either relative radial movement or pivoting movement.

As mentioned above, in the type of nozzle guide vane assembly wherein a plurality of arcuate nozzle segments are adjacently located, the segments are individually retained by a separate ring-like support shroud casing structure. Although a full nozzle ring is defined, gaps between the generally circumferentially-facing edges of adjacent segments are necessary to allow for manufacturing tolerances, and to accomodate thermal expansion. As turbine operating temperature is increased, the hot gas leakage through these gaps produces intolerable heating of the edges, particularly for a water-cooled composite nozzle designed to expose to hot gas only the surfaces forming the aerodynamic path. Leakage also has an adverse effect on efficiency. In view of these considerations, some relatively complex sealing arrangements have been proposed. Typically, however, strips of metal provide sealing.

However, in a nozzle guide vane assembly comprising high temperature, water cooled segments, water-cooling the seals is not practicable. Air cooling would not only result in inefficient operation, but would impose severe thermal gradients in the nozzle segments.

SUMMARY OF THE INVENTION

Accordingly, it is an object of the invention to provide a gas turbine engine segmented nozzle guide vane assembly which essentially eliminates gaps between individual nozzle segments.

It is another object of the invention to provide a segmented nozzle guide vane assembly including water-cooled nozzle segments and suitable for operation at relatively high temperatures.

It is yet another object of the invention to provide methods for assembling a segmented nozzle guide vane assembly into a gas turbine engine.

Briefly, and in accordance with an overall concept of the invention, arcuate nozzle segments, preferably one-vane segments, are elastically joined to each other with their generally circumferentially-facing endwall edges closely abutted to prevent leakage. The resultant nozzle ring is included within the overall turbine stationary structure and secured in a mounting arrangement which permits relative radial movement of both the inner and outer endwall rings. Circumferential retention of at least one of the endwall rings is provided, preferably the outer endwall ring, by means of a spline-type connection with suitable gaps to accomodate relative radial movement.

As part of the gas turbine stationary structure, inner and outer support structures for the nozzle ring are provided. An inner mounting arrangement mounts the inner endwall ring to the inner support structure, and an outer mounting arrangement mounts the outer endwall ring to the outer support structure. Both mounting arrangements accommodate relative radial movement.

Thus, the invention provides a complete rigid self-cooled nozzle ring with complete freedom to "float" radially by means of the spline-type connection. It will be appreciated that, even though each portion of the nozzle ring is free to move radially relative to its mounting, the entire nozzle ring nevertheless remains concentric about the turbine axis.

In accordance with the invention, the nozzle segments are not rigidly joined. Rather, the segments are elastically joined with a slightly compliant connection arrangement which accomodates tolerances. However, no significant relative movement between the individual nozzle segments occurs during turbine heatup. Preferably, slightly compliant seals between the generally circumferentially-facing endwall edges are provided, comprising for example, compressed stainless steel tubes fitted into a seal groove on one of the abutting sidewall edges.

In a method of assembly in accordance with the invention, the complete nozzle ring is formed at least segment-by-segment in place within the overall gas turbine structure, as nozzle segments are added to build up the complete structure.

Preferably, lesser pluralities of the nozzle segments are first joined into a plurality of nozzle ring sub-assemblies. Then, one of the nozzle ring sub-assemblies is initially positioned in the annular space between the nozzle ring and outer support structures. A temporary jack is employed to temporarily support the initial nozzle sub-assembly, the temporary jack extending between the inner endwall arcuate section and the nozzle ring inner support structure.

The remaining nozzle ring subassemblies are successively positioned next to each other subassembly-by-subassembly to form the complete nozzle ring in place. During the assembly process, the sub-assemblies are temporarily supported by means of further temporary jacks. The jacks are manipulated to permit the entire set of nozzle ring sub-assemblies to be fastened into a ring, the jacks constraining the partially-formed ring into a shape which allows the last nozzle ring sub-assembly to match at both edges. Once the full ring is formed, the jacks are removed except for at least two—one at the bottom, and one at the side. These two remaining jacks align the center of the ring. For providing circumferential retention, keys secured to the ring outer support structure engage slots in the nozzle outer endwall rings. A single key is sufficient to initially circumferentially position the nozzle ring as the nozzle ring is built up subassembly-by-subassembly. Thereafter, all of the keys are appropriately fitted, and the remaining temporary jacks are removed.

In a part of the specific structure provided by the invention, for elastically joining the individual nozzle segments to each other, each of the nozzle segments includes a flange projecting radially outwardly from the outer endwall adjacent each of the generally circumferentially-facing endwall edges. Each of the flanges has a front surface generally parallel to the adjacent endwall edge and abuts a corresponding flange front surface of an adjacent nozzle segment. Apertures extend generally circumferentially through the flanges in alignment with corresponding apertures in adjacent nozzle segment flanges. The actual joining arrangement comprises a tie rod extending through the apertures of each pair of corresponding flanges, with extending portions of each tie rod extending away from the rear surface of the corresponding flange. A pair of sleeves surround the tie rod extending portion on respective sides of the corresponding flanges. One end of each sleeve bears against a flange rear surface, and an enlarged portion on each tie rod end bears against the other end of each sleeve to place the tie rods in tension and the sleeves in compression. Preferably, the enlarged portions on the tie rod ends are threaded-on nuts, fitted on both ends of each tie rod to provide a symmetrical arrangement.

To aid in assembly, the generally circumferentially-facing nozzle segment endwall edges each include a generally circumferentially directed alignment pin recess in alignment with a corresponding alignment ping recess in the adjacent nozzle segment endwall edge. An alignment pin is then provided in each pair of aligned recesses.

In another part of the specific structure provided by the invention, projecting radially inwardly from each of the nozzle segment inner endwalls is an annular rib which serves two functions.

The first function of these annular ribs is to serve as a elements of the mounting arrangement mounting the inner endwall ring to the inner support structure, specifically to provide axial restraint. More particularly, a mating radially outwardly facing annular groove is formed in the inner support structure. The annular ribs extending radially inwardly from the nozzle segment inner endwalls extend into the annular groove, thus providing the axial restraint. An annular clearance space is left between the bottom of the annular groove and the outer edges of the annular ribs to accomodate relative radial movement.

As the second function, these annular ribs serve during the assembly step of joining lesser pluralities of the nozzle segments into a plurality of nozzle ring assemblies. More particularly, a plurality of arcuate inner retaining elements each having a circumferential length spanning several nozzle segments are provided. Each of the inner retaining elements includes in cross section a U-shaped portion which is fitted on the radially inwardly extending annular ribs of the nozzle segments spanned by the inner retaining element. An axially-extending aperture is formed in each of the nozzle annular ribs and a pair of apertures are formed in the sidewalls of the retaining element U-shaped portions in alignment with the nozzle segment rib apertures to form a set of aligned apertures. An inner retaining pin is then fitted through each set of aligned apertures, and the annular ribs and the U-shaped portions are positioned as a unit in the annular groove formed in the inner support structure.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION OF THE PREFERRED EMBODIMENTS

Figure 1:
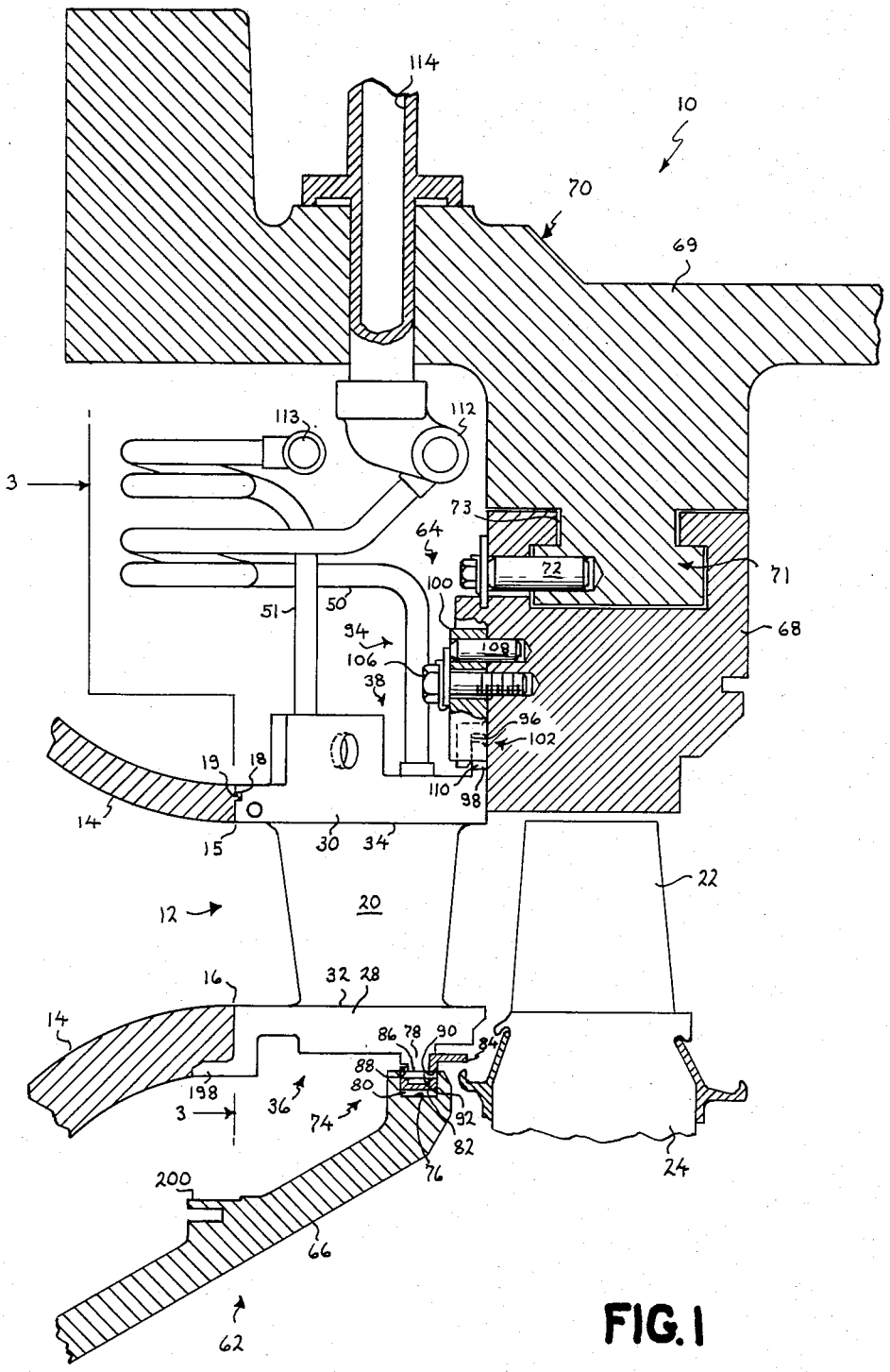
FIG. 1 is a sectional view on a gas turbine gas path taken in a radial plane on the longitudinal axis and depicting the overall configuration and mounting of the subject turbine inlet nozzle arrangement.

Referring first to FIG. 1, depicted is a longitudinal sectional view of a portion 10 of a gas turbine engine, including an inlet nozzle guide vane assembly 12 in accordance with the invention. It will be appreciated that the turbine axis (not shown) lies some distance below the turbine portion 10 depicted in FIG. 1, and that a corresponding mirror image of the FIG. 1 portion 10 could be shown an equal distance away from the other side of the turbine axis.

One or a plurality of combustors are represented by a single transition duct 14, which for convenience can be viewed as a combustor outlet. The transition duct 14 is suitably interfaced as at 15 and 16 to the inlet nozzle guide vane assembly 12 for discharging hot motive gasses into the inlet nozzle guide vane assembly 12. Exemplary interfacing details include an annular groove 18 in the nozzle guide vane assembly 12 and a mating annular ridge 19 on the transition duct 14.

Figure 2:
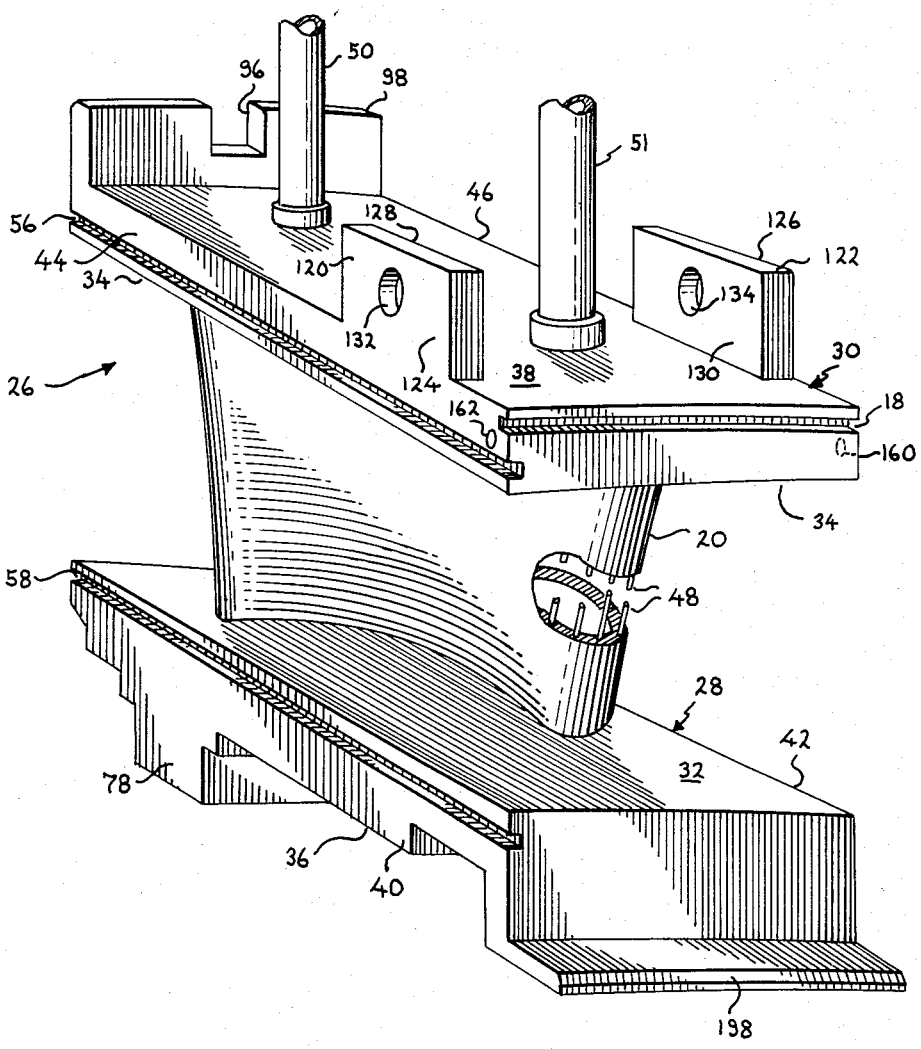
FIG. 2 is a perspective view of a single arcuate nozzle segment.
Figure 3:
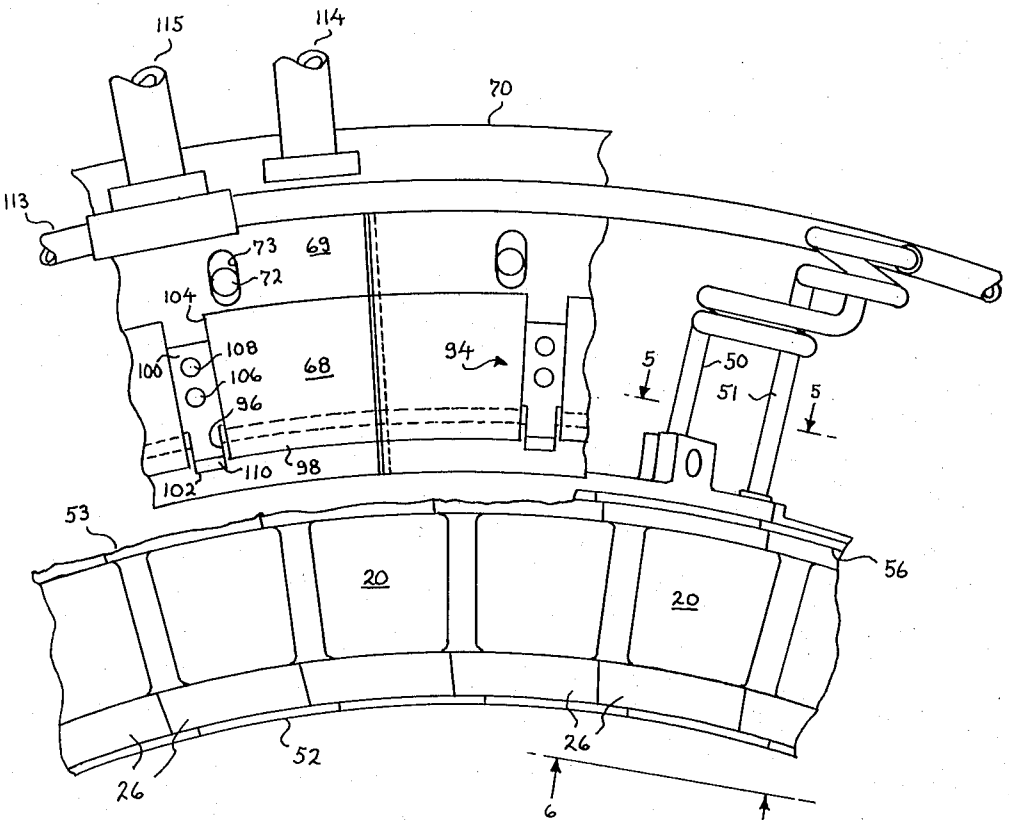
FIG. 3 is a view taken along line 3—3 of FIG. 1 looking downstream at the leading edge of several one-vane nozzle segments, with a portion cut away to show the manner in which keys circumferentially restrain nozzle segments.
Figure 7E:
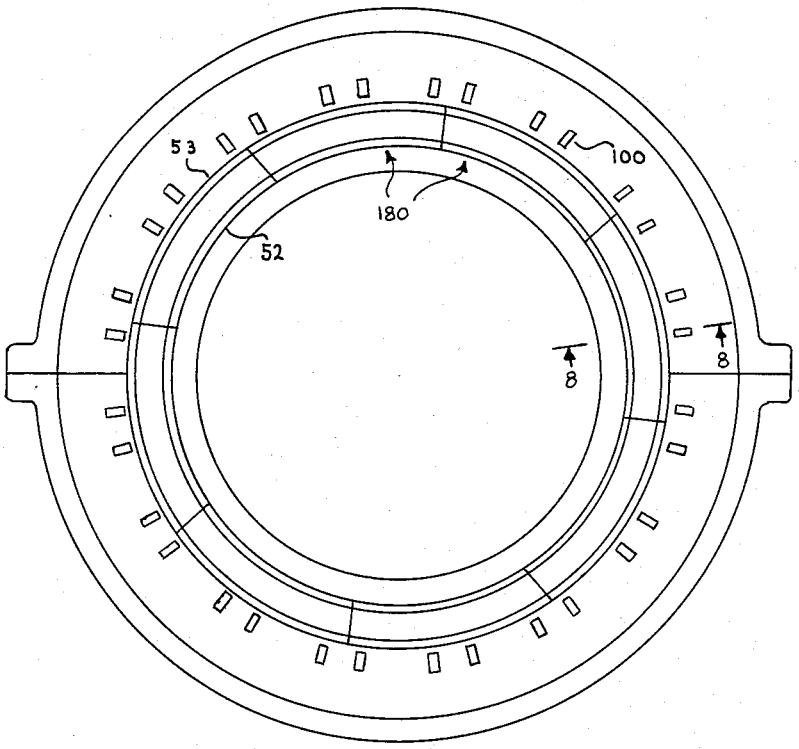
FIGS. 7A, 7B, 7C, 7D and 7E depict successive steps in an assembly process in accordance with the invention, and are downstream views oriented in a manner similar to that of FIG. 3.

Referring also to FIGS. 2 and 3, the nozzle inlet nozzle guide vane assembly 12 includes a plurality of air foil-shaped vanes 20 suitably angled for directing the motive fluid at an appropriate angle to exemplary first stage turbine buckets 22 (rotor blades) secured to the outer periphery of a turbine rotor assembly 24 mounted for rotation about the turbine axis (not shown).

More particularly, the inlet nozzle guide vane assembly 12 comprises a plurality of arcuate nozzle segments, a representative one of which is depicted in FIG. 2 and designated 26. Preferably, the arcuate nozzle segment 26 is a one-vane segment. As may best be seen from FIG. 2, each nozzle segment 26 includes the vane 20 which extends between a nozzle segment inner endwall 28 and a nozzle segment outer endwall 30. The inner and outer endwalls 28 and 30 have respective gas path surfaces 32 and 34 facing towards each other and defining a portion of an annular gas path space therebetween. The reverse sides of the nozzle segment inner and outer endwalls 28 and 30 are respectively designated 36 and 38.

The nozzle segment inner endwall 28 has a pair of generally circumferentially-facing edges 40 and 42, and the nozzle segment outer endwall 30 has a similar pair of generally circumferentially-facing edges 44 and 46. In the particular structure disclosed herein, the edges 40, 42, 44 and 46 are not truly circumferentially-facing, but rather are oriented in general alignment with the orientation of the air foil-shaped nozzle vanes 20 and at an angle with respect to longitudinal planes. It will be appreciated, however, that the orientation of the nozzle segment edges 40, 42, 44 and 46 is a design consideration outside the scope of the present invention and that, insofar as the present invention is concerned, essentially circumferentially-facing orientation may be employed, including truly circumferentially-facing.

Preferably, as represented in FIG. 2, the nozzle segment 26 is a water-cooled composite nozzle, for example, of the general type disclosed in Beltran et al U.S. Pat. No. 4,137,619, Muth et al U.S. Pat. No. 4,283,822 or in commonly-assigned U.S. patent applications of Schilke et al, Ser. No. 246,068, filed Mar. 20, 1981, now matured into U.S. Pat. No. 4,370,789 and Rairden et al, Ser. No. 246,119, filed Mar. 20, 1981, the latter application having been abandoned. Such a nozzle segment includes a number of coolant-carrying conduits 48 embedded near the surfaces of the vane 20, as well as in the endwalls 28 and 30 near the gas path surfaces 32 and 34. The conduits 48 are supplied with coolant through an inlet tube 50, and coolant exits through an outlet tube 51.

As best shown in FIG. 3, in accordance with the invention, the individual nozzle segments 26 are elastically joined to each other to form a rigid nozzle ring, in a manner described in greater detail hereinafter with particular reference to FIGS. 5 and 6. When joined, the generally circumferentially-facing edges 40, 42, 44 and 46 (FIG. 2) abut respective corresponding circumferentially-facing endwall edges of adjacent nozzle segments 26 in sealing relationship to form continuous inner and outer endwall rings or bands 52 and 53 (FIG. 3).

Figure 4:
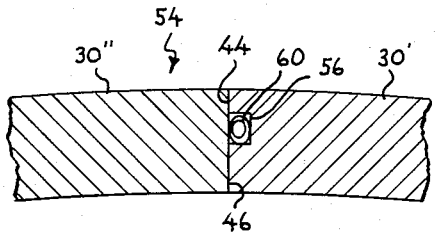
FIG. 4 is an enlarged cross-sectional view of abutting endwall edges of two adjacent nozzle segments showing a sealing arrangement.

Nominally, no gap exists between abutting endwall edges 40 and 42, or 44 and 46. However, in practice, slight initial gaps arise due to manufacturing tolerances, and small variations in the gaps are produced by axial misalignment between the nozzle assembly inner and outer retaining structures, described hereinafter. The arrangement joining individual nozzle segments 26 (described hereinafter with reference to FIGS. 5 and 6) is sufficiently flexible to absorb such variations elastically. Additionally, as depicted in FIG. 4, flexible seals between the edges are preferably employed to avoid leakage. A relatively compact seal is adequate because the gap and the gap variation during thermal cycling is small. The relatively small gap also avoids the need for special cooling of the seals.

More particularly, FIG. 4 depicts a pair 54 of outer endwalls, designated 30' and 30'', of two exemplary nozzle segments 26, the generally circumferentially-facing edge 44 of one endwall 30' abutting the generally circumferentially-facing edge 46 of the other endwall 30''. Formed in at least one of the pair 54 of endwall edges is a seal groove 56, which also may be seen in FIG. 2. Also visible in FIG. 2 is a corresponding seal groove 58 in the circumferentially-facing edge 40 of the inner endwall 28. A typical depth for the seal groove 56 is 0.090 inch.

Positioned in the seal groove 56 is a flexible seal 60, which conveniently may comprise a stainless steel tube approximately 0.125 inch in diameter, with a 0.01 inch wall thickness. When adjacent nozzle segments 26 are joined, the flexible seal 60 partially collapses, with slight residual springback to accomodate any misalignment occasioned by subsequent thermal expansion.

Referring now again to FIGS. 1 and 3, the gas turbine portion 10 includes inner and outer support structures, generally designated 62 and 64, for the nozzle ring 12.

More particularly, the inner support structure 62 comprises an inner support cone 66 comprising a part of the gas turbine stationary structure. The exemplary outer support structure 64 comprises a shroud ring 68, which typically comprises a plurality of individual shroud ring segments, in turn secured to the upper portion 69 of a turbine outer casing 70. Since the shroud ring 68 and the outer casing 70 are subjected to different temperatures, to accomodate relative thermal expansion the shroud ring 68 is connected to the outer casing 70 in a manner which accomodates this thermal expansion, typically by means of a circumferentially fitting dovetail arrangement 71, secured by a pin 72 and radial slot 73 arrangement.

An inner mounting arrangement, generally designated 74, mounts the inner endwall ring 52 to the inner support structure 62. The inner mounting arrangement 74 provides axial retention, but permits free radial movement.

More particularly, a radially outwardly facing annular groove 76 is formed in the inner support cone 66. An annular rib 78 extending radially inwardly from each of the nozzle segment 26 inner endwalls 28 extends into the annular groove 76, with an annular clearance space 80 between the bottom of the annular groove 76 and the outer edge of the annular ribs 78 to accomodate relative radial movement.

As an aid in assembly as will be apparent hereinafter, interposed between each annular rib 78 and the groove 76 is a U-shaped portion 82 of an arcuate inner retaining element 84, which is also shown in the developed view of FIG. 6. A plurality of arcuate inner retaining elements 84 are provided, each having a circumferential length spanning several (e.g., six) nozzle segments 26. As also shown in FIG. 6, both ends of each inner retaining element 84 are angled to match the joint between the generally circumferentially-facing inner endwall edges 40 and 42. The U-shaped portions 82 of the arcuate inner retaining elements 84 are fitted on the annular ribs 78, and the annular ribs 78 and U-shaped portions are positioned as a unit in the annular groove 76.

An axially-extending aperture 86 is formed in each of the nozzle segment annular ribs 78, and a pair of apertures 88 and 90 are formed in the sidewalls of the inner retaining element 84 in U-shaped portions 82 in alignment with the nozzle segment axially extending apertures 86 to form a set of aligned apertures. A stainless steel retaining pin 92 is fitted in each set of aligned apertures.

Correspondingly, an outer mounting arrangment, generally designated 94, mounts the outer endwall ring 53 to the outer support structure 64. The outer mounting arrangement 94 permits free relative radial movement of the outer endwall ring 53, and provides axial and circumferential retention.

More particularly, the outer mounting arrangement 94 includes a plurality of radially outwardly directed slots 96 (best seen in FIGS. 2 and 3) formed in a corresponding plurality of the nozzle segment 26 outer endwalls 30. To facilitate fabrication, the radially outwardly directed slots 96 specifically are formed in a radially outwardly directed flange 98 extending from the reverse side 38 of each nozzle outer endwall 30.

To provide circumferential retention, a plurality of keys 100 are secured to the outer support structure 64, more particularly, to the shroud ring 68. The keys then engage the slots 96 as at 102. The keys 100 are circumferentially held in slot-like recesses 104 in the shroud ring 68, and are secured by means of a bolt 106 and pin 108 arrangement. A clearance space 110 is left between the ends of the keys 100 and the outer endwalls 30 in order to accomodate relative radial movement.

The outer mounting arrangement 94 also provides axial restraint through abutment of the outward directed flange 98 against the shroud ring 68, pressure drop through the inner nozzle guide vane assembly 12 providing force during operation.

One of the features of the invention is that slight relative axial movement between the inner and outer support structures 62 and 64 is accommodated by the inner and outer mounting arrangements 74 and 94, as will be appreciated from the structure described.

The remaining structure in FIGS. 1 and 3 comprises a system of coolant conduits including extensions of the inlet 50 and outlet 51 tubes shown in FIG. 2. These conduits are respectively connected to a coolant inlet manifold 112, and a coolant outlet manifold 113. A coolant inlet passage 114 supplies the coolant inlet manifold 112, the coolant passage extending through the upper half 69 of the outer casing 70. Similarly, a coolant outlet passage 115 is connected to the coolant outlet manifold 113.

Figure 5:
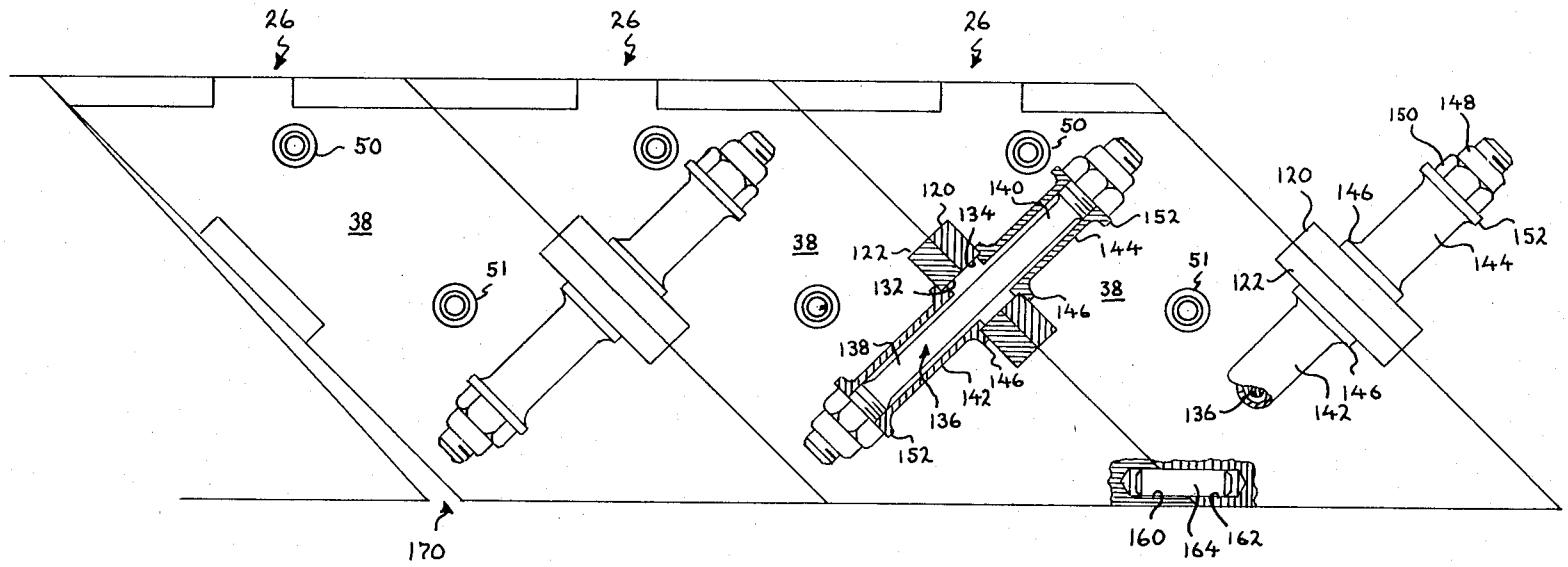
FIG. 5 is a developed view on line 5—5 of FIG. 3 showing the reverse sides of several nozzle segment outer endwalls, and the joining tie rod arrangement.
Figure 6:
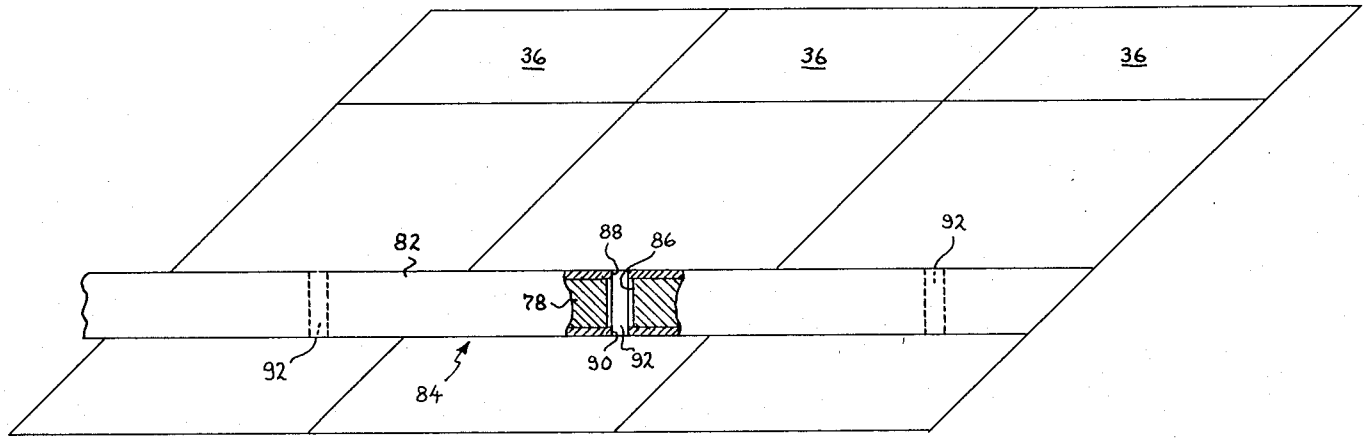
FIG. 6 is a developed view on line 6—6 of FIG. 3, with a portion broken away, showing the reverse side of the inner endwalls of several nozzle segments, and a portion of an arcuate inner retaining element which spans the several nozzle segments.
Figure 7A:
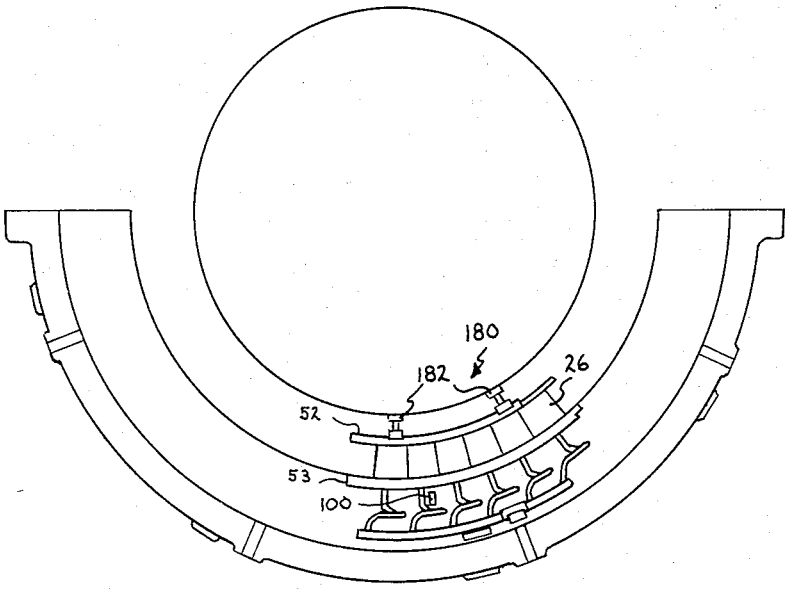
Figure 7B:
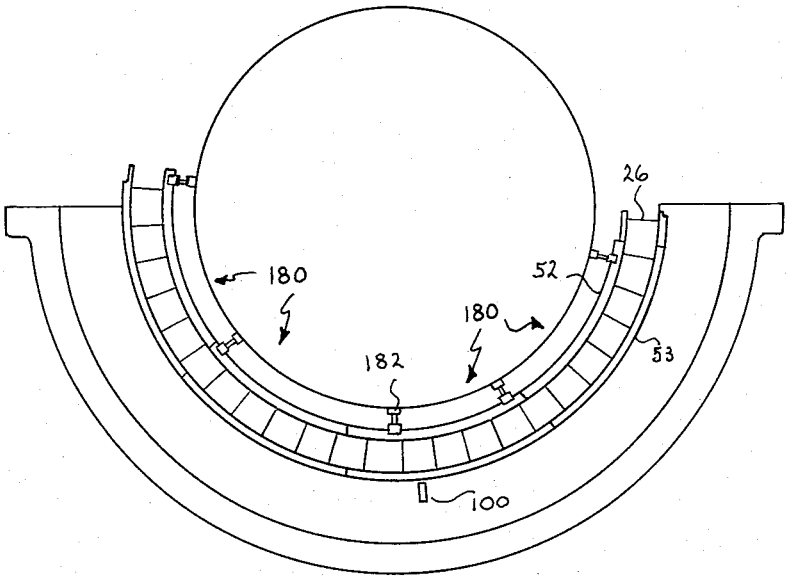
Figure 7C:
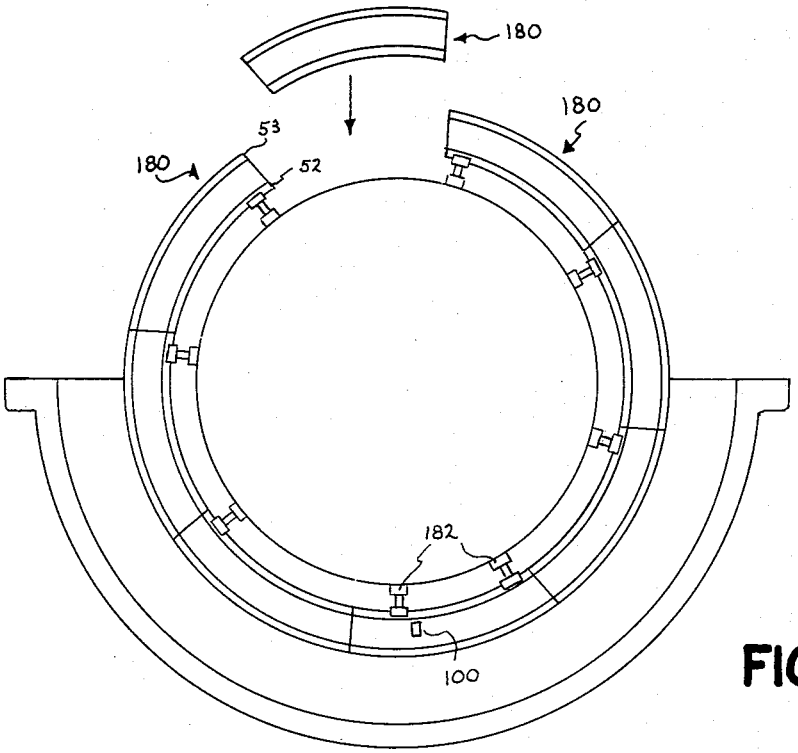
Figure 7D:
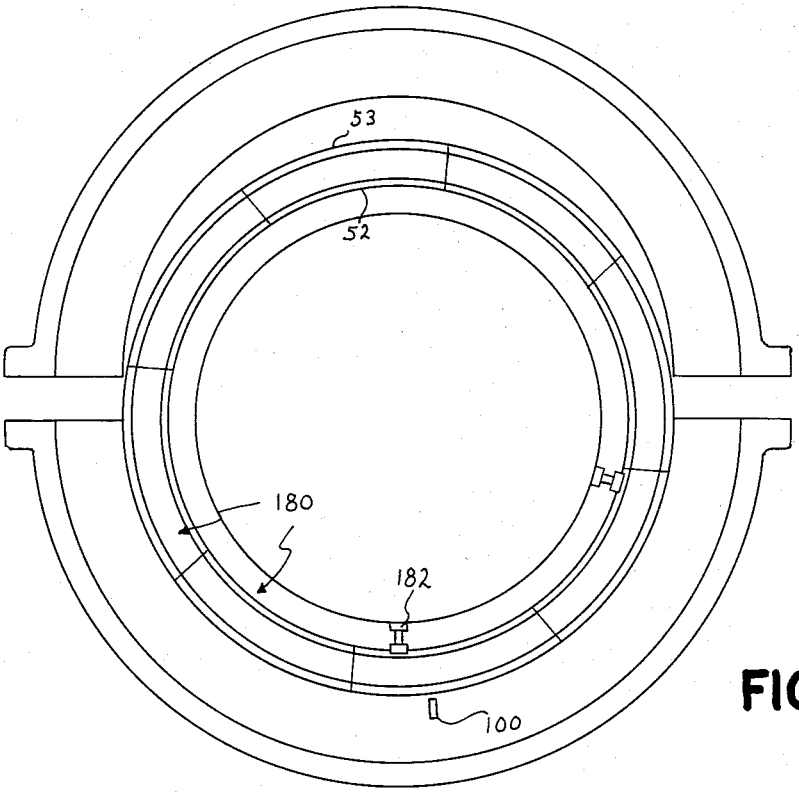

With reference now particularly to the developed view of FIG. 5, as well as to the perspective view of a single nozzle segment in FIG. 2, depicted is the manner in which individual arcuate nozzle segments 26 are elastically joined to each other. More particularly, FIG. 5 illustrates the reverse sides 38 of the outer endwalls 30 of several nozzle segments 26.

In FIGS. 2 and 5, it may be seen that each of the nozzle segments 26 includes a pair of flanges 120 and 122 projecting radially outwardly from the outer endwall 30 respectively adjacent the generally circumferentially-facing endwall edges 44 and 46. The flanges 120 and 122 have respective front surfaces 124 and 126 generally parallel to the respective adjacent sidewall edges 44 and 46. The front surfaces 124 and 126 abut corresponding front surfaces 124 or 126 of adjacent nozzle segments. The flanges 120 and 122 also have respective rear surfaces 128 and 130. Generally circumferentially-extending apertures 132 and 134 are formed in the flanges 120 and 122 in alignment with corresponding apertures 132 and 134 in the adjacent nozzle segment flanges.

As shown in FIG. 5, a tie rod 136 extends through the apertures 132 and 134 of each pair of corresponding flanges 120 and 122, with extending portions 138 and 140 of each tie rod 136 extending away from the corresponding flange rear surfaces 130 and 128.

Respectively surrounding the tie rod extending portions 138 and 140 are coaxial sleeves 142 and 144. One end 146 of each sleeve 142 or 144 bears against a corresponding flange rear surface 130 or 128. Provided on the tie rod ends are enlarged end portions 148 and 150 which bear against the other ends 152 of the sleeves 142 and 144, placing the tie rods 136 in tension and the sleeves 142 and 144 in compression.

Preferably, the enlarged end portions 148 and 150 comprise threaded-on nuts on both ends of the tie rod 136 in a symmetrical arrangement. However, it will be appreciated that other arrangements may be employed. For example, the tie rods 136 may comprise through-bolts, with a fixed head on one end and only the other end threaded to receive a nut.

The tie rods 136 preferably comprise a high strength corrosion resistant alloy with an expansion coefficient similar to that of the sleeves.

As a further aid to assembly, the circumferentially-facing endwall edges 44 and 46 include generally circumferentially-directed alignment pin recesses 160 and 162 in alignment with corresponding alignment pin recesses 160 and 162 in the adjacent nozzle segment endwall edges. Alignment pins, such as the exemplary stainless steel alignment pin 164 (FIG. 5) are located in the alignment pin recesses 160 and 162.

In FIG. 5 also may be seen, in greatly exaggerated form, an illustrative gap 170 between adjacent nozzle segments 26 such as can develop with axial misalignment between the inner and outer support structures 74 and 94. The tie rods 136 stretch elastically to accomodate gaps such as at 170. It is a feature of the invention that such axial misalignment can be tolerated.

Figure 8:
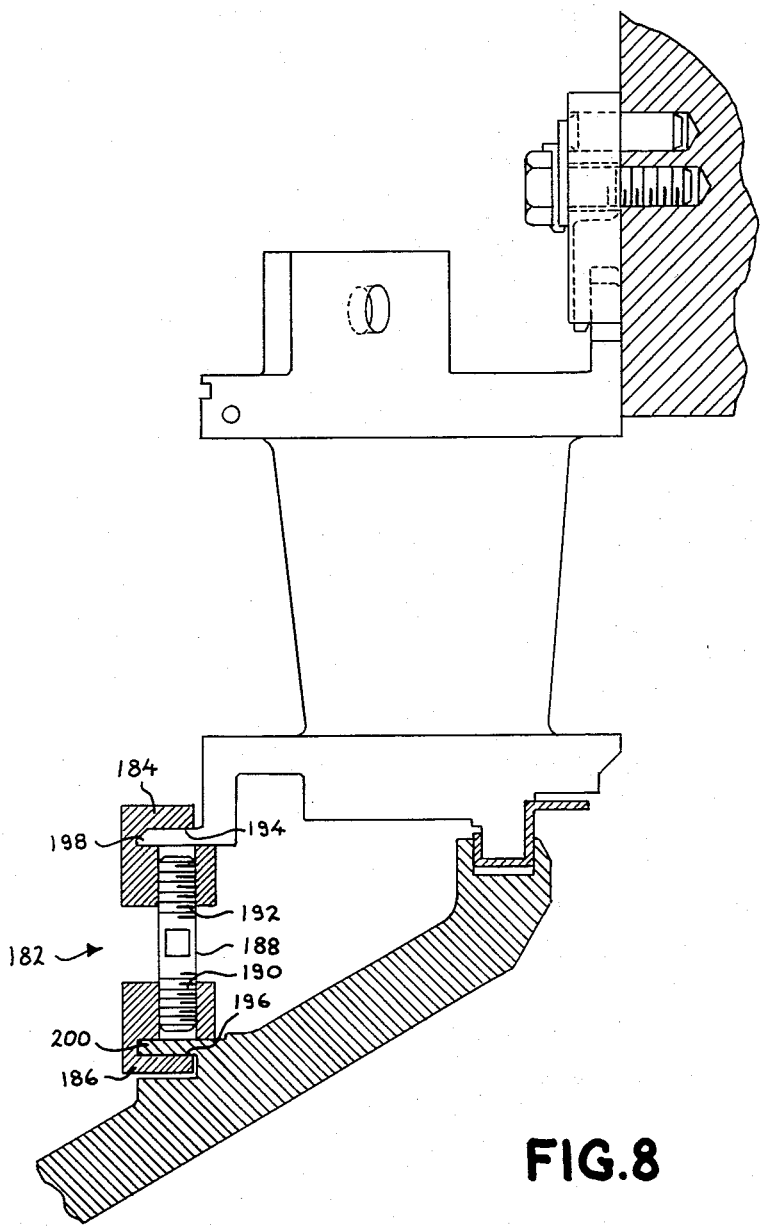
FIG. 8 is an axial section taken on line 8—8 of FIG. 7E, comparable to FIG. 1, and depicting a portion of a nozzle guide vane assembly with a temporary jack in place.

With reference now particularly to FIGS. 7A–7E and 8, depicted is a method in accordance with the invention for forming and assembling the inlet nozzle guide vane assembly 12 into the gas turbine engine. FIGS. 7A–7E are highly schematic illustrations comparable to FIG. 3, but depicting the entire nozzle ring. FIG. 8 is a view taken on line 8—8 of FIG. 7E, and is comparable to the view of FIG. 1.

In the method of assembly, a plurality of arcuate nozzle segments 26 are first provided, the nozzle segments 26 having a structure as described above. Lesser pluralities of the nozzle segments 26 are joined into a plurality of nozzle ring subassemblies, such as representative subassembly 180 (FIG. 7A) comprising six individual nozzle segments 26. The nozzle segment inner endwalls of each subassembly 180 are joined by means of the arcuate inner retaining element 84, circumferentially spanning the six individual nozzle segments 26 comprising the subassembly 180. As may be seen from FIG. 6, the end of the inner retaining element is at both ends angled to match the joint between adjacent nozzle segments. The inner retaining pins 96 (illustrated in FIG. 1) are inserted through the sets of aligned apertures 86, 88 & 90 of each set in order to tie the annular ribs 78 of the individual nozzle segments 26 comprising the subassembly 180 together.

At the same time, the nozzle segment outer endwalls 30 are connected by means of the tie rod and sleeve assembly described hereinabove with reference to FIG. 5.

To facilitate this joining, a suitable spring compressor tool (not shown) is employed to securely abut the nozzle segments 26 one against the other while the fastening is assembled.

Next, the nozzle ring subassembly 180 is positioned in the annular space between the nozzle ring inner and outer support structures 62 and 64, and is temporarily supported by at least one, and preferably a pair of jacks 182 extending between selected nozzle segment 26 inner endwalls 28 and the inner support structure 62. Initially, one key 100 is fitted.

More particularly, as shown in FIG. 8, the temporary jacks 182 each comprise a turnbuckle-like device having threaded end pieces 184 and 186 and a threaded rod 188 extending therebetween, with left and right hand threads respectively at the two ends respectively 190 and 192 of the threaded rod 188.

The jack 182 threaded end pieces 184 and 186 include respective slots 194 and 196 for respective engaging a circumferential lip 198 projecting in an upstream direction from each nozzle segment inner endwall 28, and a similar circumferential lip 200 formed on the inner support cone 66. The temporary jacks 182 thus temporarily support the nozzle segment subassembly 180 in approximate position.

As depicted in FIGS. 7B–7E, the remaining nozzle ring subassemblies 180 are successively positioned in the annular space between the inner and outer nozzle ring support structures 74 and 94 adjacent to previously-positioned nozzle ring subassemblies 180. The subassemblies are joined to each other subassembly-by-subassembly to form the complete inlet nozzle guide vane assembly 12, while the nozzle ring subassemblies 180 are temporarily supported by means of the temporary jacks 182.

In particular, the jacks 182 serve to constrain the joints of the inner endwall ring 54 while the tie rods 136 join the outer endwall ring 53. The jacks 182 are first manipulated to permit the entire set of subassemblies 180 to be fastened into a ring. It will be appreciated that the jacks 182 must constrain the partially formed ring into a shape which allows the last of the subassemblies 180 to match at both edges. Once the full inlet nozzle guide vane assembly 12 is formed, the jacks 182 are preferably removed, except for at least two (FIG. 7D), one at the bottom and one at the side. These two remaining jacks are sufficient to align the center of the inlet nozzle guide vane assembly 12 along the turbine axis.

Finally, the remaining keys 100 are individually fitted into the slots 96 in the nozzle segments 26 to provide circumferential retention. As may be seen in FIG. 3, the keys 100 are stepped in width, and are provided in several different stepped widths to facilitate selection during assembly to provide a close fit in the key slots 96.

While the specific embodiment of the invention has been illustrated and described herein, it is realized that numerous modifications and changes will occur to those skilled in the art. It is therefore, to be understood that the appended claims are intended to cover all such modifications and changes as fall within the true spirit and scope of the invention.

What is claimed is:

1. A nozzle guide vane assembly for a gas turbine engine, said assembly comprising:

a plurality of arcuate nozzle segments elastically joined to each other and forming an annular nozzle ring, each of said nozzle segments including a vane extending between a nozzle segment inner endwall and a nozzle segment outer endwall, the inner and outer endwalls of each nozzle segment having a pair of generally circumferentially-facing edges abutting respective corresponding circumferentially-facing endwall edges of adjacent nozzle segments in sealing relationship to form continuous inner and outer endwall rings;

inner and outer support structures for said nozzle ring;

an inner mounting arrangement mounting said inner endwall ring to said inner support structure, said inner mounting arrangement including means for providing axial retention and for permitting at least free relative radial movement;

an outer mounting arrangement mounting said outer endwall ring to said outer support structure, said outer mounting arrangement including means for permitting at least free relative radial movement;

at least one of said inner and outer mounting arrangements also including means for providing circumferential retention;

each abutting pair of said circumferentially-facing edges including a compressible seal therebetween;

means for applying a compressing force to each of said abutting pairs whereby said compressible seal is compressed to form an effective seal between said abutting pairs;

said means for applying a compressing force including each of said nozzle segments including a flange projecting radially outwardly from said outer endwall adjacent each of said generally circumferentially-facing endwall edges, each of said flanges having a front surface generally parallel to the adjacent endwall edge and abutting a corresponding flange front surface of an adjacent nozzle segment, and each of said flanges having a rear surface, and a generally circumferentially-extending aperture formed in each of said flanges in alignment with a corresponding aperture in the adjacent nozzle segment flange; and a tie rod extending through said corresponding apertures of each pair of corresponding flanges with extending portions of each tie rod extending away from said corresponding flange rear surface, a pair of sleeves surrounding said extending portions on respective sides of each pair of corresponding flanges with one end of each sleeve bearing against a flange rear surface, and an enlarged portion on each tie rod end bearing against the other end of each sleeve to place said tie rods in tension and said sleeves in compression.

2. A nozzle guide vane assembly in accordance with claim 1, wherein at least the end portions of said tie rods are threaded and said enlarged portions comprise threaded-on nuts.

3. A nozzle guide vane assembly in accordance with claim 1, wherein said compressible seal includes:

at least one of each pair of generally circumferentially-facing endwall edges including a seal groove in at least one of said edges; and a flexible seal positioned in said seal groove.

4. A nozzle assembly in accordance with claim 3, wherein:

said generally circumferentially-facing endwall edges each include a generally circumferentially-directed alignment pin recess in alignment with a corresponding alignment pin recess in the adjacent nozzle segment endwall edge; and a plurality of alignment pins in said alignment pin recesses.

5. A nozzle guide vane assembly for a gas turbine engine, said assembly comprising:

a plurality of arcuate nozzle segments elastically joined to each other and forming an annular nozzle ring, each of said nozzle segments including a vane extending between a nozzle segment inner endwall and a nozzle segment outer endwall, the inner and outer endwalls of each nozzle segment having a pair of generally circumferentially-facing edges abutting respective corresponding circumferentially-facing endwall edges of adjacent nozzle segments in sealing relationship to form continuous inner and outer endwall rings;

inner and outer support structures for said nozzle rings;

an inner mounting arrangement mounting said inner endwall ring to said inner support structure, said inner mounting arrangement including means for providing axial retention and for permitting at least free relative radial movement;

an outer mounting arrangement mounting said outer endwall ring to said outer support structure, said outer mounting arrangement including means for permitting at least free relative radial movement;

at least one of said inner and outer mounting arrangements also including means for providing circumferential retention;

each abutting pair of said circumferentially-facing edges including a compressible seal therebetween;

means for applying a compressing force to each of said abutting pairs whereby said compressible seal is compressed to form an effective seal between said abutting pairs;

said outer mounting arrangement including means for providing circumferential retention;

said outer mounting arrangement including a plurality of radially outwardly directed slots formed in a corresponding plurality of said nozzle segment outer endwalls; and a plurality of keys secured to said outer support structure and engaging said outwardly directed slots to circumferentially retain said nozzle ring, with clearance space between the ends of said keys and said outer endwalls to accomodate relative radial movement.

6. A nozzle guide vane assembly in accordance with claim 5, wherein said mounting arrangement comprises:

a radially outwardly facing annular groove formed in said inner support structure, and an annular rib extending radially inwardly from each of said nozzle segment inner endwalls into said annular groove, with an annular clearance space between the bottom of said groove and the outer edge of said ribs to accommodate relative radial movement.

7. A nozzle guide vane assembly in accordance with claim 6, which further comprises:

a plurality of arcuate inner retaining elements each having a circumferential length spanning several nozzle segments;

said inner retaining elements each including in cross section a U-shaped portion fitted on said annular ribs of said nozzle segments spanned by said inner retaining element;

an axially-extending aperture formed in each of said nozzle segment annular ribs and a pair of apertures formed in the sidewalls of said retaining element U-shaped portions in alignment with each of said nozzle segment rib apertures to form a set of aligned apertures; and a retaining pin in each set of aligned apertures;

said annular ribs and said U-shaped portions positioned as a unit in said annular groove.

8. A nozzle guide vane assembly in accordance with claim 7, wherein said compressible seal includes:

at least one of each pair of generally circumferentailly-facing endwall edges including a seal groove formed in said edge; and a flexible seal in said seal groove.

9. A nozzle guide vane assembly in accordance with claim 5, wherein:

each of said nozzle segments includes a flange projecting radially outwardly from said outer endwall ajacent each of said generally circumferentially-facing endwall edges, each of said flanges having a front surface generally parallel to the adjacent endwall edge and abutting a corresponding flange front surface of an adjacent nozzle segment, and each of said flanges having a rear surface, and a generally circumferentially-extending aperture formed in each of said flanges in alignment with a corresponding aperture in the adjacent nozzle segment flange; and a tie rod extending through the apertures of each pair of corresponding flanges with extending portions of each tie rod extending away from the corresponding flange rear surface, a pair of sleeves surrounding said tie rod extending portions on respective sides of each pair of corresponding flanges with one end of each sleeve bearing against a flange rear surface, and an enlarged portion on each tie rod end bearing against the other end of each sleeve to place said tie rods in tension and said sleeves in compression.

10. A nozzle guide vane assembly in accordance with claim 9, wherein at least the end portions of said tie rods are threaded and said tie rod end enlarged portions comprise threaded-on nuts.

11. A nozzle guide vane assembly for a gas turbine engine, said assembly comprising:

a plurality of arcuate nozzle segments elastically joined to each other and forming an annular nozzle ring, each of said nozzle segments including a vane extending between a nozzle segment inner endwall and a nozzle segment outer endwall, the inner and outer endwalls of each nozzle segment having a pair of generally circumferentially-facing edges abutting respective corresponding circumferentially-facing endwall edges of adjacent nozzle segments in sealing relationship to form continuous inner and outer endwall rings;

inner and outer support structures for said nozzle rings;

an inner mounting arrangement mounting said inner endwall ring to said inner support structure, said inner mounting arrangement including means for providing axial retention and for permitting at least free relative radial movement;

an outer mounting arrangement mounting said outer endwall ring to said outer support structure, said outer mounting arrangement including means for permitting at least free relative radial movement;

at least one of said inner and outer mounting arrangements also including means for providing circumferential retention;

each abutting pair of said circumferentially-facing edges including a compressible seal therebetween;

means for applying a compressing force to each of said abutting pairs whereby said compressible seal is compressed to form an effective seal between said abutting pairs;

said outer mounting arrangement including means for providing circumferential retention;

said compressible seal including at least one of each pair of generally circumferentially-facing endwall edges having a seal groove formed therein; and a flexible seal positioned in said seal groove.

12. A nozzle assembly in accordance with claim 11, wherein said flexible seal includes a stainless steel tube.

13. A nozzle assembly in accordance with claim 12, wherein:

said generally circumferentially-facing endwall edges each include a generally circumferentially-directed alignment pin recess in alignment with a corresponding alignment pin recess in the adjacent nozzle segment endwall edge; and a plurality of alignment pins located in said alignment pin recesses.

14. A nozzle assembly for a gas turbine engine, said assembly comprising:

a plurality of arcuate nozzle segments elastically joined to each other and forming an annular nozzle ring, each of said nozzle segments including a vane extending between a nozzle segment inner endwall and a nozzle segment outer endwall, the inner and outer endwalls of each nozzle segment having a pair of generally circumferentially-facing edges abutting respective corresponding circumferentially-facing endwall edges of adjacent nozzle segments in sealing relationship to form continuous inner and outer endwall rings;

inner and outer support structures for said nozzle rings;

an inner mounting arrangement mounting said inner endwall ring to said inner support structure, said inner mounting arrangement including means for providing axial retention and for permitting at least free relative radial movement;

an outer mounting arrangement mounting said outer endwall ring to said outer support structure, said outer mounting arrangement including means for permitting at least free relative radial movement;

at least one of said inner and outer mounting arrangements also including means for providing circumferential retention;

each abutting pair of said circumferentially-facing edges including a compressible seal therebetween;

means for applying a compressing force to each of said abutting pairs whereby said compressible seal is compressed to form an effective seal between said abutting pairs;

said outer mounting arrangement including means for providing circumferential retention;

said generally circumferentially-facing endwall edges each including a generally circumferentially-directed alignment pin recess in alignment with a corresponding alignment pin recess in the adjacent nozzle segment endwall edge; and a plurality of alignment pins located in said alignment pin recesses.

15. A nozzle guide vane assembly for a gas turbine engine, said assembly comprising:

a plurality of arcuate nozzle segments elastically joined to each other and forming an annular nozzle ring, each of said nozzle segments including a vane extending between a nozzle segment inner endwall and a nozzle segment outer endwall, the inner and outer endwalls of each nozzle segment having a pair of generally circumferentially-facing edges abutting respective corresponding circumferentially-facing endwall edges of adjacent nozzle segments in sealing relationship to form continuous inner and outer endwall rings;

inner and outer support structures for said nozzle rings;

an inner mounting arrangement mounting said inner endwall ring to said inner support structure, said inner mounting arrangement including means for providing axial retention and for permitting at least free relative radial movement;

an outer mounting arrangement mounting said outer endwall ring to said outer support structure, said outer mounting arrangement including means for permitting at least free relative radial movement;

at least one of said inner and outer mounting arrangements also including means for providing circumferential retention;

each abutting pair of said circumferentially-facing edges including a compressible seal therebetween;

means for applying a compressing force to each of said abutting pairs whereby said compressible seal is compressed to form an efective seal between said abutting pairs;

said outer mounting arrangement including means for providing circumferential retention;

each of said nozzle segments including a flange projecting radially outwardly from said outer endwall adjacent each of said generally circumferentially-facing endwall edges, each of said flanges having a front surface generally parallel to the adjacent endwall edge and abutting a corresponding flange front surface of an adjacent nozzle segment, and each of said flanges having a rear surface, and a generally circumferentially-extending aperture formed in each of said flanges in alignment with a corresponding aperture in adjacent nozzle segment flanges; and a tie rod extending through the apertures of each pair of corresponding flanges with extending portions of each tie rod extending away from the corresponding flange rear surface, a pair of sleeves surrounding said tie rod extending portions on respective sides of each pair of corresponding flanges with one end of each sleeve bearing against a flange rear surface, and an enlarged portion on each tie rod end and bearing against the other end of each sleeve to place said tie rods in tension and said sleeves in compression.

16. A nozzle guide assembly in accordance with claim 15, wherein said tie rods are formed of a high strength corrosion resistant alloy capable of elastic stretching.

* * * * *